United States Patent [19]

Chen

[11] Patent Number: 4,991,607

[45] Date of Patent: Feb. 12, 1991

[54] HAIRPIN

[76] Inventor: Chin J. Chen, 48, RueyMing St., ShiauGaang Dist., Kaohsiung, Taiwan

[21] Appl. No.: 461,847

[22] Filed: Jan. 8, 1990

[51] Int. Cl.[5] ..... A45D 8/28

[52] U.S. Cl. ..... 132/278; 132/279

[58] Field of Search ..... 132/275, 276, 277, 278, 132/279; 446/127; 63/20

[56] References Cited

U.S. PATENT DOCUMENTS

| | | | |
|---|---|---|---|
| 1,531,542 | 3/1925 | Cogshall | 446/127 |
| 2,170,778 | 8/1939 | Huppert | 132/278 |
| 2,406,759 | 9/1946 | Gyokes | 446/127 |
| 2,773,505 | 12/1956 | Goodman | 132/275 |
| 3,811,219 | 5/1974 | Fischer | 446/127 |

FOREIGN PATENT DOCUMENTS

| | | | |
|---|---|---|---|
| 2144206 | 3/1973 | Fed. Rep. of Germany | 132/279 |
| 3306887 | 8/1984 | Fed. Rep. of Germany | 446/122 |
| 2455444 | 1/1981 | France | 132/279 |

*Primary Examiner*—Cary E. Stone
*Assistant Examiner*—Frank A. LaViola, Jr.
*Attorney, Agent, or Firm*—Fleit, Jacobson, Cohn, Price, Holman & Stern

[57] ABSTRACT

A hairpin comprising a curved plastic plate and a metal clip having both the lengthwise ends possible to be pinched between both the inner wall faces of the projecting walls respectively at both the lengthwise ends of the plastic plate.

2 Claims, 3 Drawing Sheets

HAIRPIN

BACKGROUND OF THE INVENTION

A conventional hairpin, as shown in FIG. 1, comprises a curved plastic plate combined with a curved metal plate B by means of two projecting posts C set on the plastic plate inserted and fused in two holes D in the metal plate B. In combining process heat fusion of the post C must be performed by a heat gun, which wastes time and labor and is rather inconvenient. Besides, the fusing time has to be controlled to be correct, otherwise combination of the plastic plate with the metal plate would not be tight, and the metal plate may easily loosen off the plastic plate in the result.

SUMMARY OF THE INVENTION

In view of the defects of the conventional hairpin mentioned above, the object of this invention is to provide a fine clipping structure for a hairpin, more securely and easily combining both the plates.

The hairpin in accordance with the present invention comprises a curved plastic plate and a metal clip as the main components.

The curved plastic plate is provided with a projecting wall respectively at both the inner side of both the lengthwise ends and the inner wall face respectively has a central post to engage with a notch provided in both the lengthwise ends of the metal clip.

The metal clip has the same curved direction and degree as that of the plastic plate, provided with a notch respectively at both the lengthwise ends to engage with the central posts of both the projecting walls of the plastic plate. The distance between both the notches is a little longer than that between the inner wall faces so that the metal clip can expand a little to be pinched between the inner wall faces of the plastic plate when the metal clip is bended a little shorter, placed between said inner wall faces and then released The metal clip can be kept therein without dropping off the plastic plate by means of its elasticity.

BRIEF DESCRIPTION OF THE DRAWINGS

This invention will now be described in detail with reference to accompanying drawings wherein.

DETAILED DESCRIPTION OF THE INVENTION

Figure 1:
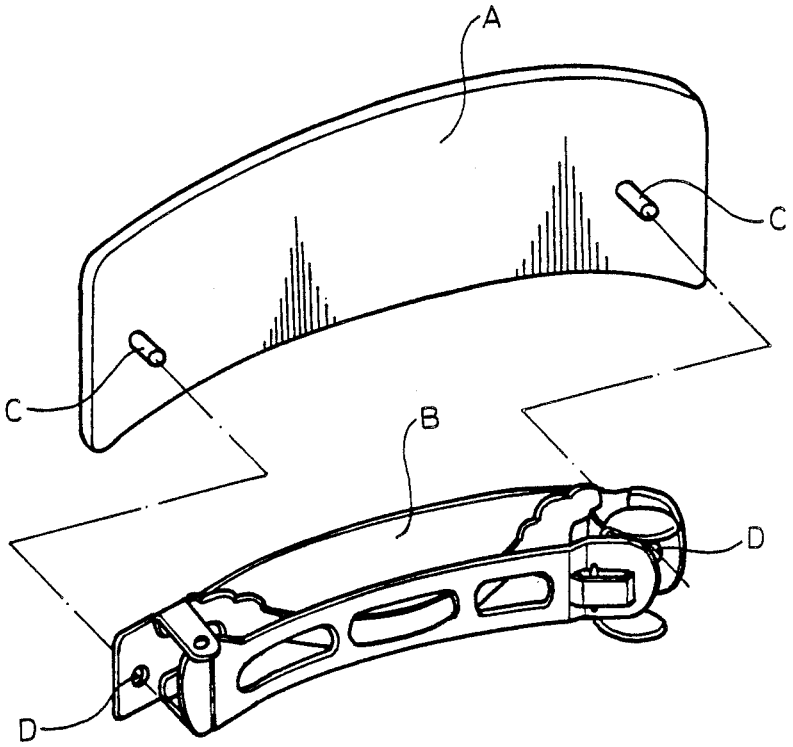
FIG. 1 (PRIOR ART)
FIG. 1 is a perspective view of a conventional hairpin.
Figure 2:
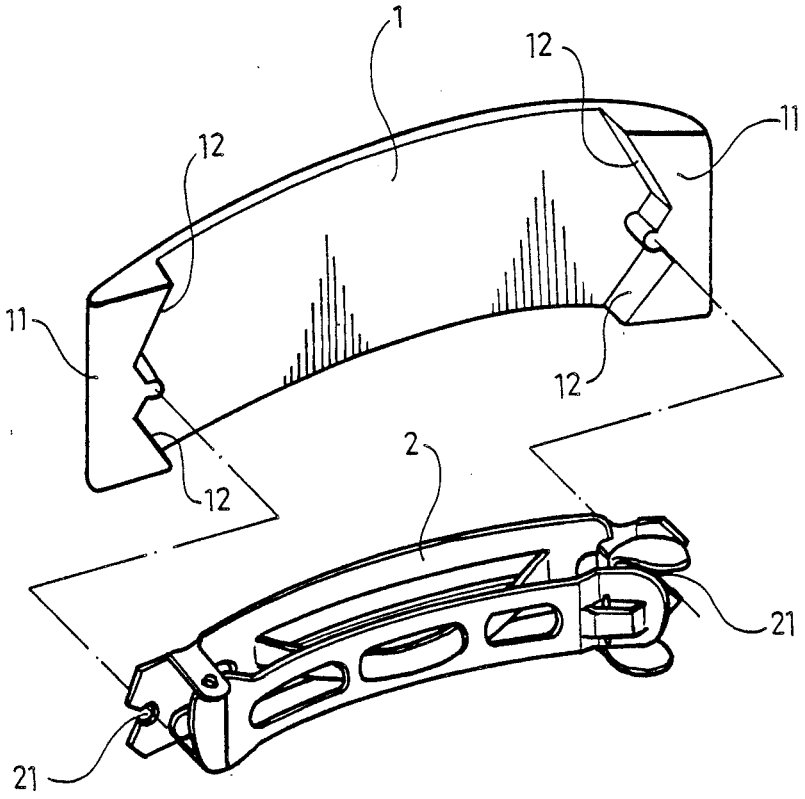
FIG. 2 is a perspective view of the hairpin in accordance with the present invention.

The hairpin in accordance with the present invention comprises a plastic plate 1 and a metal clip 2 as its main components.

The plastic plate 1 is slowly curved and provided with a projecting wall 11 respectively at both lengthwise ends projecting inward and an inner wall face 12 respectively having a middle post. The inner walls 11 have a certain thickness.

The metal clip 2 has the same structure as a conventional hairpin, made of stainless steel and provided with a notch 21 respectively at both the lengthwise ends of its bottom. The two notches 21 match and engage with the middle posts in the inner wall faces 12 of the plastic plate 1. The distance between both the notches 21 is a bit longer than both the inner wall faces 12. The plastic plate 1 and the metal clip 2 have the same curving direction and degree.

Figure 3:
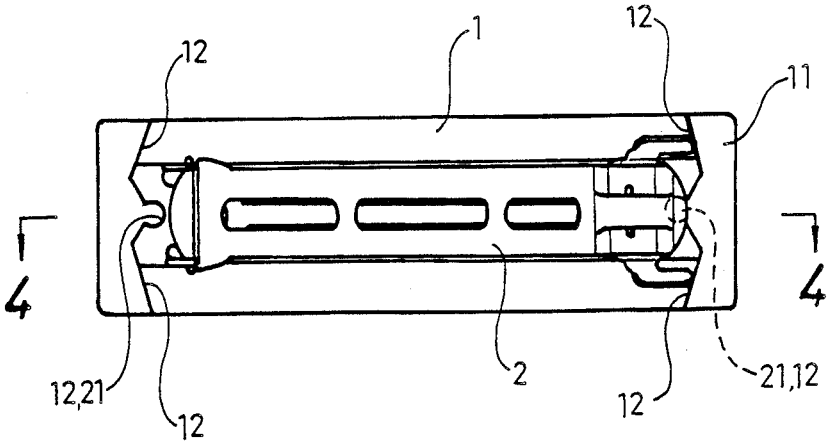
FIG. 3 is a bottom view of the hairpin in accordance with the present invention.
Figure 4:
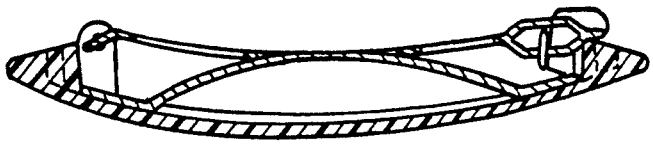
FIG. 4 is a cross-sectional view taken along line 4—4 of FIG. 3.

Next, referring to FIGS. 3 and 4, to combine the metal clip 2 with the plastic plate 1, the metal clip 2 is to be forcedly bended a little shorter to be interposed between both the inner wall faces 12 of the plastic plate 1 with the notches 21 engaging with said faces 12. Then the metal clip 2 is to be released to expand and elastically push both the inner wall faces 12, makeing itself steadfastly stay therein. As both the plastic plate 1 and the metal clip 2 have the same curving direction and degree, the metal clip 2 can be kept rested side by side on the plastic plate without dropping off.

What is claimed is:

1. A hairpin comprising a curved plastic plate and a curved metal clip having a base conforming substantially in curvature to the curvature of the plate, said plastic plate provided with a projecting wall respectively at the inner side of both lengthwise ends thereof, the inner side of each projecting wall having an inner wall face which is provided with a central post, the base of the metal clip being resiliently compressed lengthwise between the inner wall faces of the plastic plate, said metal clip is provided with a notch respectively at both the lengthwise ends to engage with the central posts of the inner wall faces of the plastic plate, the distance between said notches in an uncompressed state of the clip being a little longer than the distance between the inner wall faces of the plate whereby the base of the clip is retained on the plate by the resilient lengthwise compression of the base.

2. A hairpin comprising a curved plastic plate and a curved metal clip having a base conforming substantially in curvature to the curvature of the plate, said plastic plate provided with a projecting wall respectively at the inside of both lengthwise ends thereof, the base of the metal clip being resiliently compressed lengthwise between the inner wall faces of the plastic plate, the base of the clip and the respective walls of the plate having inter engaging male and female formations respectively and the distance between the formations on the base of the clip in an uncompressed state of the clip being a little longer than the distance between the formations on the inner wall faces of the plate whereby the base of the clip is retained on the plate by the resilient lengthwise compression of the base.

* * * * *